US005397530A

United States Patent [19]

Narasimhan et al.

[11] Patent Number: 5,397,530

[45] Date of Patent: Mar. 14, 1995

[54] METHODS AND APPARATUS FOR HEATING METAL POWDERS

[75] Inventors: K. S. V. L. Narasimhan, Moorestown, N.J.; Johan Arvidsson, Nyhamnslage, Sweden; Howard G. Rutz, Newtown, Pa.; W. John Porter, Jr., Fairfield, Ohio

[73] Assignee: Hoeganaes Corporation, Riverton, N.J.

[21] Appl. No.: 190,269

[22] Filed: Feb. 2, 1994

Related U.S. Application Data

[63] Continuation-in-part of Ser. No. 54,009, Apr. 26, 1993, abandoned.

[51] Int. Cl.[6] ..... B22F 3/16

[52] U.S. Cl. ..... 419/1; 419/30; 419/31; 419/35; 419/38; 419/53; 419/55

[58] Field of Search ..... 419/1, 30, 38, 31, 35, 419/45, 53, 55, 62, 63, 64

[56] References Cited

U.S. PATENT DOCUMENTS

| | | | |
|---|---|---|---|
| 2,299,192 | 10/1942 | Tormyn | 75/22 |
| 3,570,391 | 3/1971 | Rejler | 99/326 |
| 3,645,728 | 2/1972 | Hrinevich, Jr. | 75/214 |
| 3,989,518 | 11/1976 | Rueckl | 75/211 |
| 4,345,983 | 8/1982 | Wan | 204/158 R |
| 4,452,756 | 6/1984 | McLeod | 419/29 |
| 4,559,429 | 12/1985 | Holcombe | 219/10.55 F |
| 4,574,038 | 3/1986 | Wan | 204/162 R |
| 4,585,619 | 4/1986 | Westin | 419/28 |
| 4,666,775 | 5/1987 | Kim et al. | 428/398 |
| 4,689,458 | 8/1987 | Levendusky et al. | 219/10.55 E |
| 4,735,591 | 4/1988 | Branovich et al. | 445/50 |
| 4,840,767 | 6/1989 | Branovich et al. | 419/27 |
| 4,849,020 | 7/1989 | Osborne et al. | 106/281.1 |
| 4,857,266 | 8/1989 | Sheinberg et al. | 419/22 |
| 4,865,921 | 9/1989 | Hollenberg et al. | 428/461 |
| 4,883,936 | 11/1989 | Maynard et al. | 219/10.55 F |
| 4,892,579 | 1/1990 | Hazelton | 85/0.5 B |
| 4,895,699 | 1/1990 | Branovich et al. | 419/27 |
| 4,908,246 | 3/1990 | Fredricks et al. | 428/34.1 |
| 4,911,626 | 3/1990 | Branovich et al. | 419/27 |
| 4,914,717 | 4/1990 | Gibbon | 219/10.55 M |
| 4,938,673 | 7/1990 | Adrian | 419/23 |
| 4,942,278 | 7/1990 | Sheinberg et al. | 219/10.55 M |
| 4,946,499 | 8/1990 | Sakuranda et al. | 75/343 |
| 4,952,360 | 8/1990 | Gibbon | 264/148 |
| 5,030,820 | 7/1991 | Gibbon | 219/10.55 R |
| 5,072,087 | 10/1991 | Apte et al. | 219/10.55 M |
| 5,092,706 | 3/1992 | Bowen et al. | 404/77 |
| 5,094,238 | 3/1992 | Gibbon | 128/403 |
| 5,134,260 | 7/1992 | Piehler et al. | 219/10.41 |
| 5,137,587 | 8/1992 | Schultz et al. | 148/103 |
| 5,137,588 | 8/1992 | Wecker et al. | 148/103 |
| 5,211,896 | 5/1993 | Ward et al. | 264/126 |

OTHER PUBLICATIONS

William L. Wade, Jr., "Method of Forming Ferrite Impregnated Resins For Microwave Measurements," Army Electronics Command, Fort Monmouth, N.J., Availability: *IEEE Transactions on Magnetics,* v. MAG-10, n1, pp. 96–97, Mar. 1974.

Ostwald, R., "Thin Polymer Layers for Corrosion Protection of Microwave Components," *Werkstoffe und Korrosion,* Aug, 1990, 41 (8), 451–456.

A. Harrison, "The Use of Formable Powder Technology for Precoat Applications," *Powder Coating* '90, Cincinnati, Ohio, 9–11 Oct. 1990, Gardner Publications, 6.1–6.22.

(List continued on next page.)

*Primary Examiner*—Donald P. Walsh
*Assistant Examiner*—Chrisman D. Carroll
*Attorney, Agent, or Firm*—Woodcock Washburn Kurtz Mackiewicz & Norris

[57] ABSTRACT

A method for heating metal powder, e.g., iron powder, comprises irradiating the powder with microwaves. The powder may be coated with various materials to enhance the heating effects of the microwave. For example, the powder may be coated with a non-emissive material, such as a ceramic material. The powder may also be coated with a dipole material, such as water or plastic, or a dielectric material.

39 Claims, 3 Drawing Sheets

OTHER PUBLICATIONS

J. E. Japka, "Metallurgical Characterization of Iron Micropowders," Aerospace and Defense Technologies, 1991 P/M, Tampa, Florida, USA, 4–6 Mar. 1991, *Metal Powder Industries Federation,* pp. 79–91.

T. E. Phillips, et al., "Substitution of Copper by Iron in the Superconducting Ceramic Oxide EuBa sub 2 Cu sub 3 0 sub y: Structure, Electrical Conductivity and Microwave Response," *J. Supercon.,* Jun. 1989, 2 (2), 306–316.

K. Satoh et al.; "A New Method of Microwave Coremaking: The K—Y Process," *Transactions of the American Foundrymen's Society,* vol. 90, Chicago, Ill., 19–12 Apr. 1982, pp. 445–452.

L. E. Murr, "Explosive Processing of Bulk Superconductors," *Materials and Manufacturing Processes,* 1991, 6 (1), pp. 1–32.

L. Kempfer, "Forming the Pieces of the Ceramic Puzzle," *Mater. Eng.* (Cleveland), Jun. 1990, 107 (6), 23–26.

Hackler, C. L., "Latest Porcelain Enamel Application Technology For Appliance Components," *Ceram. Eng. Sci. Proc., 1988, pp. 375–379.*

Rowson, N. A., "Desulphurisation of Coal Using Low Power Microwave Energy," *Miner. Eng.,* 1990, 3 (3–4), pp. 363–368.

S. Iwama, "Preparation of Ultrafine Nitride Particles by Applying Microwave Plasma to Gas Evaporation Technique," *J. Soc. Mater. Sci.,* Japan, Nov. 1987, 36 (410), 1162–1166.

Taylor Lyman, ed., *Metals Handbook*, vo. 1, "Properties and Selection of Metals," p. 62, (American Society for Metals, 1961).

Ancorsteel 1000, 1000B, 1000C, "Atomized Steel Powders For High Performance Powder Metallurgy Applications," Hoeganaes Corporation, 1990.

Ancorsteel 4600V, "Atomized Low Alloy Steel Powder For Parts Requiring High Hardenability," Hoeganaes Corporation, 1988.

METHODS AND APPARATUS FOR HEATING METAL POWDERS

CROSS REFERENCE TO RELATED APPLICATION

This is a continuation-in-part of U.S. patent application Ser. No. 054,009, filed Apr. 26, 1993, now abandoned.

FIELD OF THE INVENTION

The present invention relates generally to the field of metallurgy and more particularly to processes for heating unpacked metal powders.

BACKGROUND OF THE INVENTION

In several known metallurgical operations, metal powder is heated for various purposes, such as annealing of the powder, hot compaction of the powder, or coating of the powder. A "powder" is defined as a collection of particles. In several of the known applications, a compact made from the powder is heated to remove lubricants and to increase the compact cohesiveness (sintering). Most of the known heating techniques make use of radiant heat furnaces. While radiant heat is effective in heating compacts of metal particles that have metal to metal contact, they are ineffective in heating loose powder. This is because the thermal conductivity of a powder is less than that of a solid compact. For example, the thermal conductivity of iron powder is one hundred times less than that of a solid compact of iron.

In addition, induction heating (operating at 1000 Hz) has been known to produce eddy currents in metals and has been used for melting and heat treating solid metals. In connection with heating a metal powder, this technique would involve placing the powder in a solid container and employing induction to heat the container. The container would then transmit the heat to the powder. However, due to the poor heat conductivity of powder, this method is ineffective.

SUMMARY OF THE INVENTION

A primary object of the present invention is to provide improved methods for heating metal powders. This object is achieved by the inventive processes disclosed herein, which include irradiating the powder with microwaves.

According to one aspect of the present invention, a process for heating a metal powder comprises the following steps: First, a free-flowing particulate metal powder comprising iron-based particles is provided. The expression "free-flowing powder" refers generally to a loose or unpacked powder. More specifically, "free-flowing" means that the particles have a measurable flow rate as determined by the ASTM B213-77 test method. For example, the metal powder may have a flow rate of less than about 50, preferably less than about 40, and more preferably less than about 35, seconds per 50 grams of powder as defined by the ASTM standard. Subsequently, the iron-based particles are irradiated with microwaves for a time and energy level sufficient to heat the iron-based particles. In presently preferred embodiments of the invention, the particles are heated at least about 10 Centigrade degrees above ambient.

According to another aspect of the present invention, a process for compacting a metal powder into a compacted part comprises the steps of providing a free-flowing particulate metal powder comprising iron-based particles; conveying the metal powder to a compaction die; heating the free-flowing metal powder by subjecting the metal powder to microwave irradiation; and compacting the heated metal powder within the compaction die to form a compacted part. Preferably, the powder is heated before it is injected into the die. However, if the powder is heated while it is in the die, the die will preferably be made of aluminum.

According to another aspect of the present invention, a process for removing the residual water from a composition of water-atomized iron-based particles is provided. The water is removed by irradiating the powder with microwave energy to heat the powder to a temperature at which the water is evaporated or driven off.

Other aspects of the present invention are described below.

DETAILED DESCRIPTION OF PREFERRED EMBODIMENTS

Figure 1:
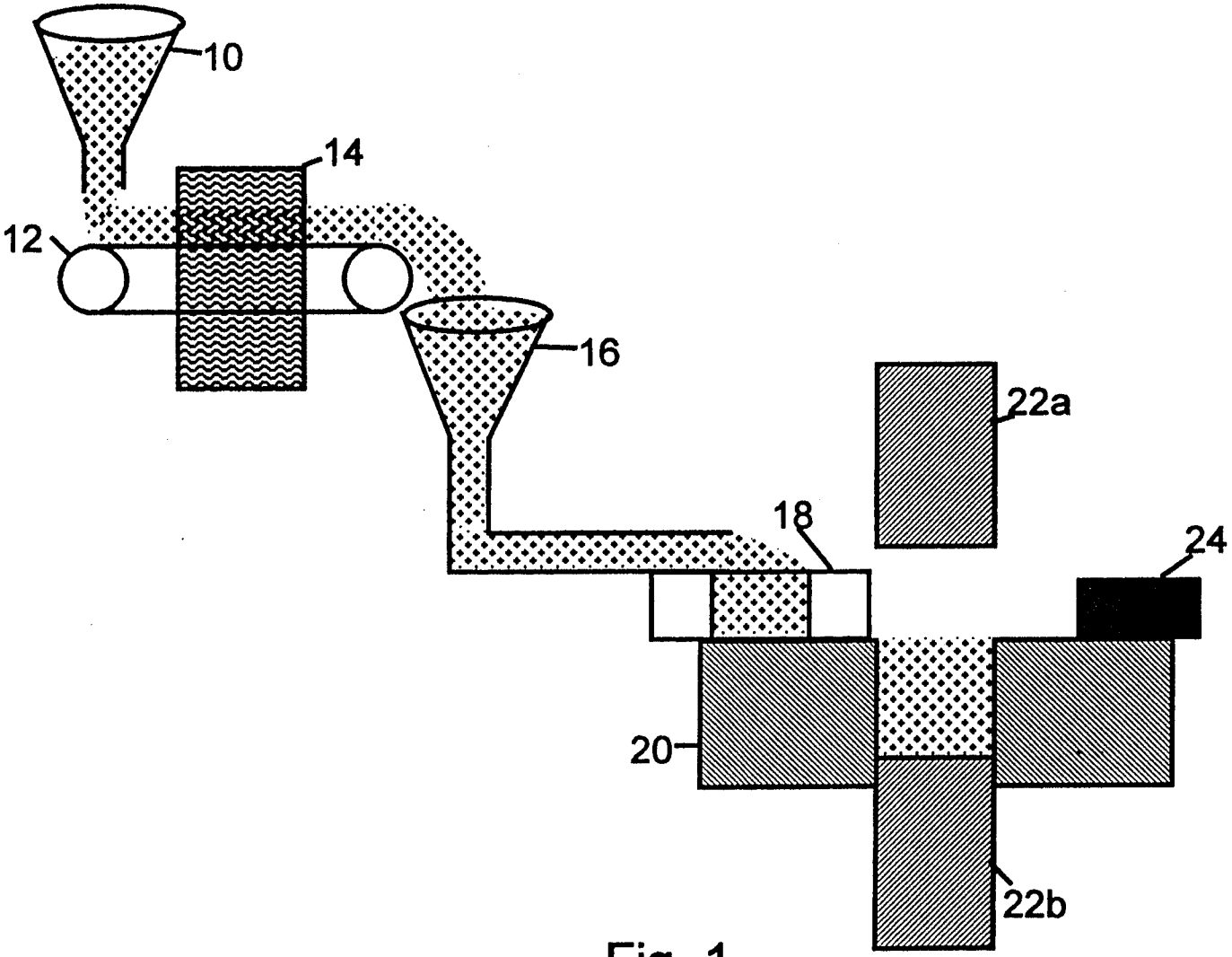
FIG. 1 is a schematic diagram of a system for heating metal powders in accordance with the present invention.

FIG. 1 depicts a system for heating metal powders in accordance with the present invention. The inventive system includes a feeder 10 for feeding the powder to a belt 12. The belt 12 carries the powder into a processing chamber 14, which includes means for irradiating the powder with microwaves for a specified period of time and at a specified power level. The system further comprises a hopper 16; feed shoe 18; compaction die 20 (which may be hot or cold); and upper and lower punches *22a*, *22b* (which may also be hot or cold). A compacted or pressed part 24 is also shown. The powder to be heated may comprise, for example, substantially pure iron particles; pre-alloyed iron-based particles; iron-based particles coated with a thermoplastic material; iron-based particles coated with a non-emissive material, e.g., a ceramic material; iron-based particles coated with a dipole material; or iron-based particles coated with a dielectric material.

The metal powders that are particularly useful in carrying out the invention comprise the iron-based particles commonly employed in the powder metallurgy industry. Such iron-based particles include any of the iron or iron-containing (including steel) particles that can be admixed with particles of other alloying materials for use in standard powder metallurgical methods. Examples of iron-based particles are particles of pure or substantially pure iron; particles of iron pre-alloyed with other elements (for example, steel-producing elements); and particles of iron to which such other elements have been diffusion-bonded. The particles of iron-based material useful in this invention can have a weight average particle size up to about 500 microns, but generally the particles will have a weight average particle size in the range of about 10–350 microns. Preferred are particles having a maximum average particle size of about 150 microns, and more preferred are particles having an average particle size in the range of about 70–100 microns.

The preferred iron-based particles for use in the invention are highly compressible powders of substantially pure iron; that is, iron containing not more than about 1.0% by weight, preferably no more than about 0.5% by weight, of normal impurities. Examples of such metallurgical grade pure iron powders are the ANCORSTEEL 1000 series of iron powders (e.g. 1000, 1000B, and 1000C) available from Hoeganaes Corporation, Riverton, N.J. As a particular example, ANCORSTEEL 1000C iron powder, which has a typical screen profile of about 13% by weight of the particles below a No. 325 sieve and about 17% by weight of the particles larger than a No. 100 sieve with the remainder between these two sizes (trace amounts larger than No. 60 sieve). The ANCORSTEEL 1000C powder has an apparent density of from about 2.8 to about 3.0 g/cm$^3$.

An example of a pre-alloyed iron-based powder is iron pre-alloyed with molybdenum (Mo), a preferred version of which can be produced by atomizing a melt of substantially pure iron containing from about 0.5 to about 2.5 weight percent Mo. Such a powder is commercially available as Hoeganaes ANCORSTEEL® 85HP steel powder, which contains 0.85 weight percent Mo, less than about 0.4 weight percent, in total, of such other materials as manganese, chromium, silicon, copper, nickel, or aluminum, and less than about 0.02 weight percent carbon.

The diffusion-bonded iron-based particles are particles of substantially pure iron that have a layer or coating of one or more other metals, such as steel-producing elements, diffused into their outer surfaces. One such commercially available powder is DISTALOY 4600A diffusion bonded powder from Hoeganaes Corporation, which contains 1.8% nickel, 0 55% molybdenum, and 16% copper.

The alloying materials that are admixed with iron-based particles of the kind described above are those known in the metallurgical arts to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferro-alloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum.

The alloying materials are used in the composition in the form of particles that are generally of finer size than the particles of iron-based material with which they are admixed. The alloying-element particles generally have a weight average particle size below about 100 microns, preferably below about 75 microns, more preferably below about 30 microns, and most preferably in the range of about 5–20 microns. The amount of alloying material present in the composition will depend on the properties desired of the final sintered part. Generally the amount will be minor, up to about 5% by weight of the total powder weight, although as much as 10–15% by weight can be present for certain specialized powders. A preferred range suitable for most applications is about 0.25–4.0% by weight.

The iron-based particles, when blended with an alloying powder, can be further combined with various binding agents such as those set forth in U.S. Pat. Nos. 4,483,905 and 4,834,800. Furthermore, such binding agents as hydroxyalkyl cellulose resins and phenolic thermoplastic resins as set forth in commonly assigned U.S. application Ser. No. 46,234 filed Apr. 13, 1993,currently pending, can also be used. The amount of binding agent utilized is minor, generally from about 0.005–3%, preferably from about 0.05∝1.5%, by weight of the metal powder composition.

The iron-based particles can also be provided in the form of thermoplastic coated particles, in which each particle consists essentially of the metal powder particle surrounded by a substantially uniform circumferential coating of the thermoplastic material. Typical thermoplastic materials include polyethersulfones, polyetherimides, polycarbonates, and polyphenylene ethers. The amount of the thermoplastic material is generally from about 0.001–15%, preferably from about 0.4–2%, by weight of the coated particles. Coated particles of this kind are described in U. S. Pat. No. 5,198,137.

The irradiation techniques of the present invention are advantageously utilized to heat the powder in warm compaction processes. According to the invention, microwave irradiation is used to heat the powder composition prior to its compaction within a die cavity.

To effectively heat such metal powder compositions, each individual particle is heated by radiation, with little thermal conduction from particle to particle. The metallic particles can be heated by inducing eddy currents on the particles' surface, such as by applying current to a conductor or semiconductor from induced electromotive force (e.m.f.). If the current is alternating, eddy currents persist. Eddy currents produce heat, which can be expressed in terms of energy loss as:

$$W_e = k\frac{\pi T^2 B^2 f^2}{\rho}$$

where, $W_e$ is the eddy current energy loss, T is the thickness of the individual particles, B is the induced flux density, f is the frequency of the e.m.f., $\rho$ is the resistivity of the metal particles, and k is a proportionality constant. As indicated by the above equation, the higher the frequency, the greater the eddy current loss; moreover, if the material is magnetic, induced magnetic flux in the material (represented by B) significantly enhances the loss of heat. Therefore, it is possible to heat iron powder directly by electromagnetic radiation, provided high frequency energy is employed.

Figure 2:
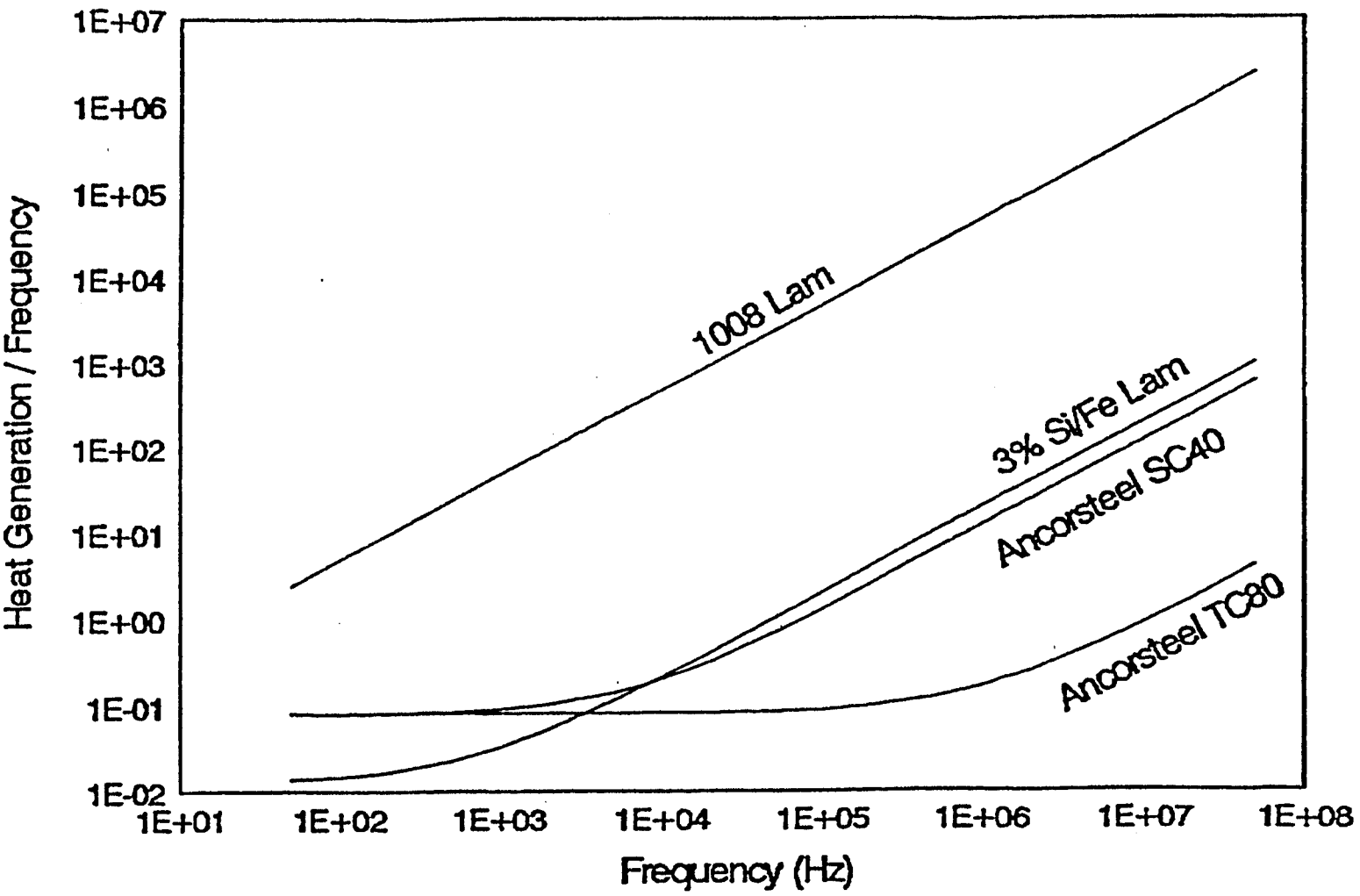
FIG. 2 is a plot of heat generation vs. frequency for different materials, including 1008 LAM (Carbon steel lamination), 3% Si/lam (Fe-3% Silicon lamination steel), ANCORSTEEL SC40 (plastic coated iron powder compacted to a torroid), and ANCORSTEEL TC80 (Phosphorous coated Iron with a plastic coating compacted into a torroid).

FIG. 2 depicts the frequency dependence of core loss, a measure of heat generation, for different materials. Heating effects generally become important at a frequency exceeding 1 MHz ($10^6$ Hz), although for some materials heating effects are significant at lower frequencies, such as $10^4$ Hz or $10^5$ Hz. The data depicted in FIG. 2 was collected using a primary exciting alternating current and measuring the voltage in the secondary circuit using a watt-hour meter. The heating effect is enhanced in materials that conduct magnetic flux, since the heating effect ($W_e$) is strongly influenced by the flux density, i.e., $W_e$ increases as the square of B. The flux density in a material is a function of the permeability ($\mu$) of the material. The higher the permeability, the more rapidly the flux density reaches its maximum value. Eddy currents are also significant in non-magnetic materials having relatively small values of resistivity.

As depicted in FIG. 2, the maximum benefit of heating can be achieved only at frequencies greater than 1000 times the radio frequencies used in the induction method. Despite the abundant literature about microwaves and their non-applicability to metals, the present inventors have discovered that microwaves can be employed to heat metal powders. The following examples demonstrate the effectiveness of the present invention in heating metal powders.

The irradiation technique of the present invention is advantageously employed in, but not limited to, processes for the compaction of the metal powder within a die according to standard metallurgical techniques, at "warm" temperatures as understood in the metallurgy arts. Generally, the metal powder compositions are blended with a lubricant to enhance the compaction process and to inhibit die wear and scoring. Examples of useful lubricants include zinc stearate, molybdenum sulfide, boron nitride, ACRAWAX available from Glyco Chemical Co., and PROMOLD 450 available from Morton International, and combinations thereof.

The process for heating and compacting the iron-based metal powders and any alloying powders, lubricants, and binding agents, as above described, using the irradiation techniques of the present invention can be accomplished in the following manner. The metal powder is fed into a feed hopper by a conveying means, such as a conveyor belt, as depicted in FIG. 1. The metal powder is subjected to the irradiation while being transported along the conveyor belt and the powder is thus heated to a certain extent. The metal powder is then transferred into the feed hopper and subsequently into a feed shoe which in turn meters a portion of the metal powder into the die cavity. The location of the irradiation means can be at any position along the route of transfer of the metal powder to the die cavity. The transfer route is preferably insulated to retain the heat imparted to the metal powder. The irradiation heating can thus be used to bring the metal powder to a desired temperature prior to its being fed into the die. The die itself is also preferably heated to the desired compaction temperature. The irradiation with microwave energy can be used to heat the metal powder to increase the temperature of the metal powder by up to about 700 Centigrade degrees, generally from about 10–500 Centigrade degrees above ambient temperature, and more preferably from about 35–350 Centigrade degrees above ambient.

The compaction temperature—measured as the temperature of the composition as it is being compacted—for metal powders which do not contain a coating of a thermoplastic material, can be as high as 370° C. Preferably the compaction is conducted at a temperature above 100° C., preferably at a temperature of from about 150° C. to about 370° C., more preferably from about 175° C. to about 260° C. Typical compaction pressures are about 5–200 tons per square inch (tsi) (69–2760 MPa), preferably about 20–100 tsi (276–1379 MPa), and more preferably about 25–60 tsi (345–828 MPa). These green compacts are then commonly sintered, according to standard metallurgical techniques, at temperatures and other conditions appropriate to the composition of the metal powder.

The compaction temperature for metal powder compositions containing a thermoplastic coating is generally above the glass transition temperature of the thermoplastic material. Preferably, the die and composition are heated to a temperature that is about 25–85 Centigrade degrees above the glass transition temperature. Normal powder metallurgy pressures are applied at the indicated temperatures to press out the desired component. Typical compression molding techniques employ compaction pressures of about 5–100 tsi (69–1379 MPa), preferably in the range of about 30–60 tsi (414–828 MPa). Following the compaction step, the molded component is optionally heat treated. According to this procedure, the molded component, preferably after removal from the die and after being permitted to cool to a temperature at least as low as the glass transition temperature of the polymeric material, is separately heated to a "process" temperature that is above the glass transition temperature, preferably to a temperature up to about 140 Centigrade degrees above the temperature at which the component was compacted. The molded component is maintained at the process temperature for a time sufficient for the component to be thoroughly heated and its internal temperature brought substantially to the process temperature. Generally, heating is required for about 0.5–3 hours, depending on the size and initial temperature of the pressed part. The heat treatment can be conducted in air or in an inert atmosphere such as nitrogen.

The irradiation technique of the present invention is also advantageously employed in the removal of water from a metal powder. Metal powders produced by atomization processes contain significant amounts of water, typically from about 1 to about 10, more generally from about 1 to about 5, percent by weight of the metal powder. This atomized powder is then generally processed to remove a bulk of the water by means of filtration whereby the water content is lowered to below about 1 percent by weight, but generally above about 0.1 percent by weight. This filtered atomized metal powder can be subjected to the irradiation for a time and intensity sufficient to remove a substantial amount of the residual water and typically the remaining water content is below about 0.1, and generally below about 0.01, and preferably below about 0.005, percent by weight of the metal powder. Other means for the removal of water can be used in conjunction with the irradiation means such as the use of a rotary kiln, which supplies radiation heat to the powder.

The removal of water, typically in the form of moisture, from the metal powders being conveyed to the compaction process by the use of the irradiation energy is also another advantageous use of the techniques of the present invention.

EXAMPLE 1

Iron powder was placed in a ceramic tray 250 mm×160 mm×10 mm thick. The tray containing the powder was exposed to 722 Watts of microwave energy at a frequency of 2415 MHz. The temperature was monitored with thermocouples located in the bed of iron powder. The bulk of the sample reached 150° C. and the temperature at the surface was 100° C. The corners had hot spot of 200° C.

EXAMPLE 2

It became apparent that the hot spots were occurring as a result of non-shielding. Therefore, a shield was connected to the tray edge to evenly distribute the microwaves. The hot spots were eliminated by this technique. A uniform powder temperature of 150° C.±8° C. was recorded throughout the bed of powder.

EXAMPLE 3

It was recognized that the iron powder radiated heat to the cold surroundings. The heat loss was considerable above 100° C. Therefore, hot air at a temperature of 150° C. was blown on the surface of the powder. This resulted in a temperature increase to 150° C. in a shorter time.

EXAMPLE 4

A plastic coating (Ultem) was applied to the iron powder and the powder was heated in a microwave oven. The temperatures reached were much higher. For example, a temperature of 300° C. was recorded. In this case, it is believed that the heating due to the dipole nature of the plastic and the eddy current heating of the iron powder combined to produce a higher temperature.

A non-emissive coating (e.g., a ceramic such as $Al_2O_3$) may also be applied to the powder to prevent the heat loss. Alternatively, a combination of a non-emissive coating and a dipole coating (e.g., water or plastic, which absorb microwave energy) may be applied. The latter method benefits from the heating effects of the dipole coating and the reduced heat loss afforded by the non-emissive coating to achieve a higher temperature.

EXAMPLE 5

Figure 3:
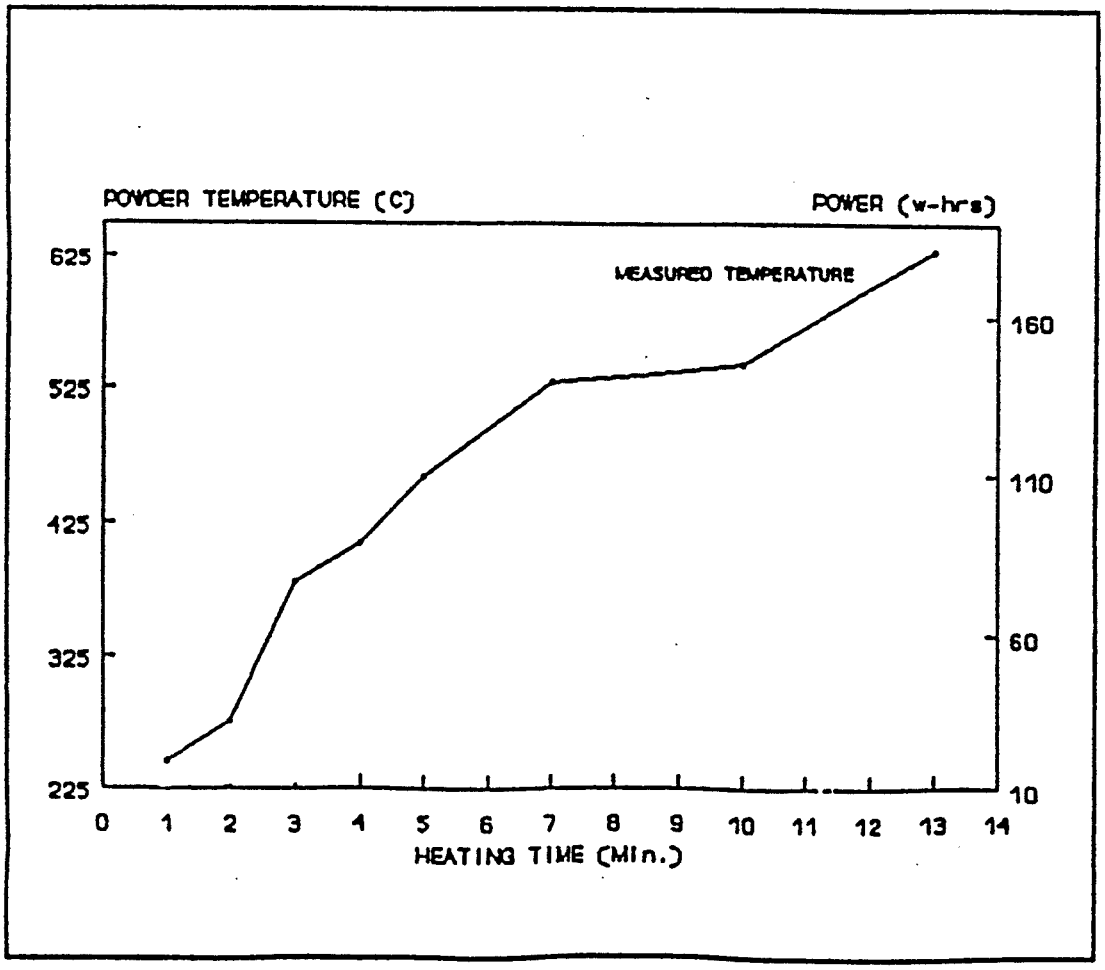
FIG. 3 is a plot of the heating characteristics of Iron powder in terms of powder temperature and power (Watt-hours) over heating time.

Iron powder (369.46 grams) was heated for an extended period of time in order to drive the temperature higher. FIG. 3 illustrates the heating characteristics of the powder in terms of powder temperature and power over heating time.

EXAMPLE 6

An attempt was made to dry a wet powder, since such drying is of interest in the manufacture of iron powder by water atomizing. Water (95 grams) was added to iron (1800 grams) and the mixture was heated for several minutes. The weight loss was measured after every minute of exposure to microwave energy to monitor water removal. The table below shows the results.

| Time (min.) | Energy Input (W-Hrs.) | Wt. Loss (Grams) |
|---|---|---|
| 1 | 11.31 | 3 |
| 2 | 22.63 | 19 |
| 3 | 33.95 | 23 |
| 4 | 45.24 | 36 |
| 5 | 56.55 | 50 |
| 6 | 67.86 | 60 |
| 7 | 79.17 | 85 |
| 8 | 90.48 | 87 |
| 9 | 110.85 | 88 |

EXAMPLE 7

A mixture of iron powder (ANCORSTEEL (A1000B), available from Hoeganaes Corporation), 0.6% graphite, and 0.75% acrawax lubricant was exposed to microwaves and the temperature rise was monitored. It took 2.6 minutes to heat 1.8 kilograms of powder from 25° C. to 180° C. In another experiment, ANCORSTEEL (A1000B) iron powder was mixed with 0.9% graphite, 2% copper, and 0.75% lubricant and this mixture was exposed to microwaves. The powder heated from 25° C. to 180° C. in 2.6 minutes. In another experiment, Hoeganaes alloy powder 4600 V was mixed with 0.6% graphite and 0.75% acrawax and exposed to microwaves with similar results. From these experiments it is clear that the iron powder is primarily responsible for absorbing the microwaves.

We claim:

1. A process for heating a metal powder, comprising:
(a) providing a free-flowing particulate metal powder comprising iron-based particles; and
(b) irradiating said iron-based particles with microwaves for a time and energy level sufficient to heat said iron-based particles to a temperature of from about 100° C. to about 370° C.

2. The process of claim 1 wherein said iron-based particles comprise substantially pure iron particles.

3. The process of claim 1 wherein said iron-based particles comprise pre-alloyed iron-based particles.

4. The process of claim 1 wherein said iron-based particles comprise iron-based particles coated with a thermoplastic material.

5. The process of claim 1 wherein said iron-based particles comprise iron-based particles coated with a non-emissive material.

6. The process of claim 5 wherein said non-emissive material comprises a ceramic material.

7. The process of claim 1 wherein said iron-based particles comprise iron-based particles coated with a dipole material.

8. The process of claim 7 wherein said dipole material comprises a material which absorbs microwave energy.

9. The process of claim 1 wherein said iron-based particles comprise iron-based particles coated with a dielectric material.

10. The process of claim 9 wherein said dielectric material comprises an electrically insulating material.

11. A process for compacting a metal powder into a compacted part, comprising:
(a) providing a free-flowing particulate metal powder comprising iron-based particles;
(b) conveying said metal powder to a compaction die;
(c) heating said metal powder by subjecting said metal powder to microwave irradiation, wherein said heating step comprises heating said metal powder to a temperature of from about 100° C. to about 370° C.; and
(d) compacting said heated metal powder within said compaction die to form a compacted part.

12. The process of claim 11 wherein said heating step comprises heating said metal powder to a temperature of from about 150° C. to about 370° C.

13. The process of claim 11 further comprising sintering said compacted part.

14. The process of claim 11 wherein said iron-based particles comprise substantially pure iron particles.

15. The process of claim 11 wherein said iron-based particles comprise pre-alloyed iron-based particles.

16. The process of claim 11 wherein said metal powder further comprises at least one alloying element powder and a binding agent.

17. The process of claim 11 wherein said iron-based particles comprise iron-based particles having a coating of either a dipole material, a dielectric material, or non-emissive material.

18. The process of claim 17 wherein said non-emissive material comprises a ceramic material.

19. The process of claim 17 wherein said dipole material absorbs microwave energy.

20. The process of claim 17 wherein said dielectric material comprises electrically insulating material.

21. The process of claim 11 wherein said iron-based particles comprise iron-based particles coated with a thermoplastic material.

22. The process of claim 21 wherein said heating step comprises heating said metal powder to a temperature above the glass transition temperature of the thermoplastic material.

23. A process for removing water from a powder metallurgy composition, comprising:

(a) providing a metal powder composition comprising atomized iron-based particles and water; and (b) removing water from said metal powder composition by irradiating said metal powder composition with microwave energy to a temperature of from about 100° C. to about 370° C.

24. The process of claim 23 wherein said metal powder composition has an initial water content of from greater than about 0.1 percent by weight prior to said irradiation step.

25. The process of claim 24 wherein the water content of said metal powder composition after said irradiation step is below about 0.01 percent by weight.

26. The process of claim 25 wherein said iron-based particles comprise substantially pure iron particles.

27. A process for forming a compacted part, comprising the steps of:

(a) providing an unpacked powder comprising iron-based particles;

(b) heating said unpacked powder to a temperature of from about 100° C. to about 370° C. by irradiating said powder with microwaves;

(c) subsequently feeding the heated powder to a die; and (d) compacting the powder in said die.

28. The process of claim 27 wherein said iron-based particles comprise substantially pure iron particles.

29. The process of claim 27 wherein said iron-based particles comprise pre-alloyed iron-based particles.

30. The process of claim 27 wherein said iron-based particles comprise iron-based particles coated with a thermoplastic material.

31. The process of claim 27 wherein said iron-based particles comprise iron-based particles coated with a non-emissive material.

32. The process of claim 31 wherein said non-emissive material comprises a ceramic material.

33. The process of claim 27 wherein said iron-based particles comprise iron-based particles coated with a dipole material.

34. The process of claim 27 wherein said iron-based particles comprise iron-based particles coated with a dielectric material.

35. The process of claim 27 further comprising heating said die to a compaction temperature prior to charging the powder to said die.

36. The process of claim 1 wherein said iron-based particles comprise diffusion-bonded iron-based particles.

37. The process of claim 11 wherein said iron-based particles comprise diffusion-bonded iron-based particles.

38. The process of claim 23 wherein said iron-based particles comprise diffusion-bonded iron-based particles.

39. The process of claim 27 wherein said iron-based particles comprise diffusion-bonded iron-based particles.

* * * * *